United States Patent [19]

Allmer

[11] Patent Number: 4,770,103

[45] Date of Patent: Sep. 13, 1988

[54] METHOD AND APPARATUS FOR EXCHANGING RAILWAY CROSS TIES WITH RAIL CLAMPING MECHANISM TO PREVENT RAIL FLEXURE

[75] Inventor: Franz Allmer, Sophia, N.C.

[73] Assignee: Canron Corporation, Cayce-West Columbia, S.C.

[21] Appl. No.: 848,346

[22] Filed: Apr. 4, 1986

Related U.S. Application Data

[63] Continuation of Ser. No. 465,592, Feb. 10, 1983, abandoned.

[51] Int. Cl.[4] ..... E01B 29/10

[52] U.S. Cl. ..... 104/71; 104/9; 37/104

[58] Field of Search ..... 104/9, 15, 7.2, 7.1; 37/104

[56] References Cited

U.S. PATENT DOCUMENTS

| | | | |
|---|---|---|---|
| 2,996,016 | 8/1961 | Keller | 104/9 |
| 3,832,952 | 9/1974 | Hurni | 104/7.2 |
| 4,323,013 | 4/1982 | Theurer | 104/7.2 |
| 4,399,753 | 8/1983 | Theurer et al. | 104/7.2 |
| 4,579,060 | 4/1986 | Wameny et al. | 104/9 |

FOREIGN PATENT DOCUMENTS

| | | | |
|---|---|---|---|
| 964117 | 3/1975 | Canada | 104/9 |

OTHER PUBLICATIONS

Brochure entitled, "Portec's RMC TKO Machine, Bulletin TKO-200.

*Primary Examiner*—Robert B. Reeves
*Assistant Examiner*—Scott H. Werny
*Attorney, Agent, or Firm*—Ronald P. Kananen

[57] ABSTRACT

In a track maintenance vehicle, a cross tie exchanging mechanism is mounted on the vehicle comprising jaws which grip the end of the cross tie to be removed and operate to pull the cross tie from the road bed laterally from beneath the track rail and also operate to push a new cross tie laterally beneath the rails into the road bed. Rail clamps are provided to grip each rail at two spaced positions along each track rail to prevent the track rail from flexing when the track rail is unfastened from the cross tie to be removed. The rail clamps are also used to lift the track rails clear of the cross ties prior to operation of the tie exchanging mechanism to remove and replace a cross tie. A beam member supports the rail clamp so that the rails are laterally stabilized when lifted. The beam member is continuously laterally positioned independent of the lateral movement of the vehicle by a guide member relative to the rails when the rail clamp is not engaged with the rails.

26 Claims, 2 Drawing Sheets

METHOD AND APPARATUS FOR EXCHANGING RAILWAY CROSS TIES WITH RAIL CLAMPING MECHANISM TO PREVENT RAIL FLEXURE

This application is a continuation of application Ser. No 465,592, filed Feb. 10, 1983, now abandoned.

BACKGROUND OF THE INVENTION

This invention relates to a rail bed maintenance apparatus and, more particularly, to a vehicle with apparatus for removing and replacing railway cross ties from a rail bed.

In U.S. Pat. No. 4,418,625, assigned to the assigneee of this application, there is disclosed an apparatus which provides for efficient replacement of railway cross ties. In this apparatus, a vehicle designed to travel along the railway track is provided. A tie exchanging mechanism, mounted on the vehicle, comprises a pair of jaws on each side of the vehicle, adapted to grip the ends of the railway cross ties in the road bed and a hydraulic mechanism to move either pair of jaws laterally with respect to the rails. When a pair of jaws of the tie exchanging mechanism has gripped the end of a tie, the hydraulic mechanism can be operated to pull the cross tie from beneath the rails. After a tie has been removed from beneath the rail, a new tie may be substituted for the tie that has just been removed using the same tie exchanging mechanism, but in this instance, the mechanism will push the new tie into place. Because the tie gripping jaws are provided and can be operated on each side of the vehicle, a tie may be removed and replaced from either side of the rail bed.

The machine, described above, has proved to provide an efficient technique of replacing railway cross ties. However, in some instances, when a tie is being replaced, the track rails will flex out of proper alignment, particularly in hot weather. When this happens, it is difficult to get the flexed rail back into proper alignment and it sometimes becomes necessary to replace the flexed portion of the rail by cutting out the flexed section and rewelding a new section in place.

SUMMARY OF THE PRESENT INVENTION

In accordance with the present invention, the problem of the rails flexing is avoided by providing a rail clamp for both track rails on the vehicle between the front and back wheels of the vehicle. The rail clamps are operable to grip the track in two places adjacent to the tie exchanging mechanism. In operation, the vehicle is driven to a position with the tie exchanging mechanism over a railroad cross tie to be replaced. When the vehicle is brought to a stop in the proper position, the rail clamps on both sides of the vehicle are clamped to both track rails. The tie is then unfastened from the track rails and the rail clamps are raised to lift the rails slightly so that the tie fastening hardware clears the cross ties. Because the rail clamps grip the rail in two places adjacent to the tie when it is unfastened from the rail, flexing of the rail is prevented. Then, in the same manner as described in the above-mentioned patent, the tie exchanging mechanism grips the end of the tie and pulls the cross tie out from beneath the rail. The tie exchanging mechanism may be then used to push a new cross tie into the track bed in place of the one just removed. After the new cross-tie has been inserted, the clamps are lowered to lower the rails back to their original position and the rails are refastened to the newly inserted tie. After the rails have been fastened to the new tie, the rail clamps release the grip upon the rails, and the vehicle moves on the track to the next cross tie to be replaced.

PREFERRED EMBODIMENT OF THE INVENTION

Figure 1:
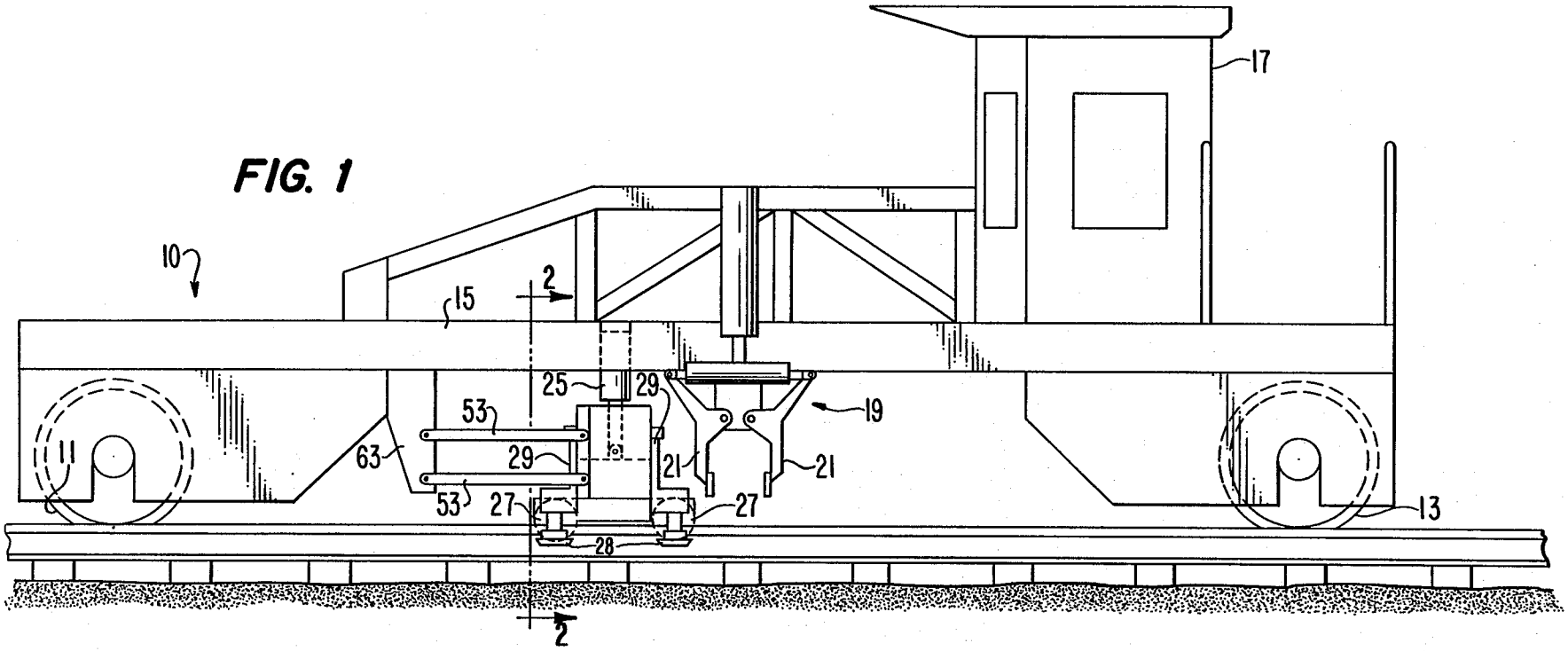
FIG. 1 is a view in elevation of the track maintenance apparatus of the present invention.
Figure 2:
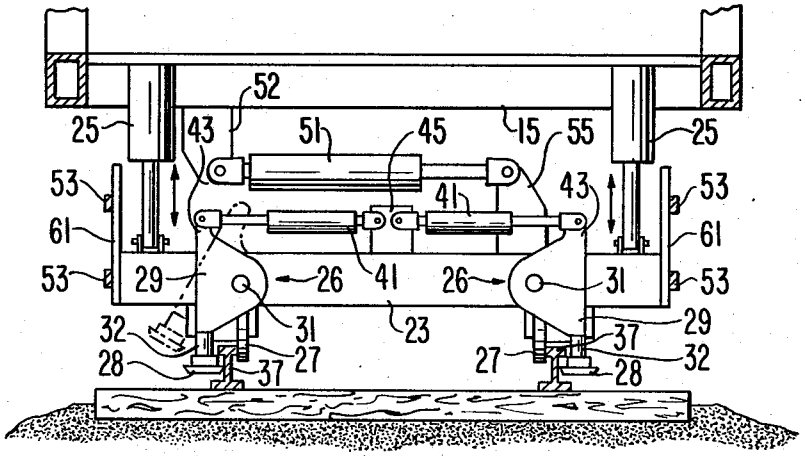
FIG. 2 is a sectional view of the track maintenance apparatus taken along the line 2—2 in FIG. 1.

As shown in FIGS. 1 and 2 of the drawings, the track maintenance apparatus of the present invention comprises a vehicle 10 adapted to travel along the railway track including a pair of front railway wheels 11, a pair of rear railway wheels 13 and a bridge 15 supported to extend between the front and rear wheels 11 and 13. Mounted on the bridge 15 is a cab 17 from which the vehicle can be driven in a forward or reverse direction by means of a motor, not shown. Suspended from the bridge 15 is cross tie exchanging mechanism 19 identical to that disclosed in the the aforementioned U.S. Pat. No. 4,418,625, the disclosure of which is hereby incorporated by reference. As disclosed in this patent, the tie exchanging mechanism 19 includes a pair of jaws 21 on each side of the track (only one pair is visible in the drawings) and the jaw pair on each side can be independently lowered and operated to grip the end of a railway cross tie. In addition, either pair of jaws 21 can be hydraulically actuated to move laterally with respect to the track rails to pull the cross tie grasped by the jaws 21 outwardly from beneath the rails. Thus, the tie exchanging apparatus 19 can pull a tie out from beneath the rails from either side of the track.

In accordance with the present invention, a rail locking mechanism is provided, comprising a support beam 23 positioned to extend laterally with respect to the rails beneath the bridge 15. The vertical position of the support beam 23 can be raised or lowered with respect to the bridge 15 by means of hydraulic cylinders 25 which suspend the beam 23 from the bridge 15. Mounted on each side of the beam 23 is a rail clamp 26, each clamp being operable to grip the rail at two positions spaced apart along the rail. Each rail clamp 26 comprises a pair of line-up roller wheels 27 spaced apart along the track rail and a pair of pivoted clamping arms 29, one opposite each line-up wheel 27. The line-up wheels 27 are adapted to be positioned inside and engage the inside edge of the rails when the hydraulic cylinders 25 lower the beam 23 to its lower position in which it is shown in FIG. 2. Each pair of clamping arms 29 are pivotally mounted on the cross-member 23 by means of an axle 31 extending parallel to the rails and the arms of each pair are pivoted to move together in unison between a position in which they clamp the track against the rollers 27, as shown in FIG. 2, and a raised position where they are disengaged from the track. A disc 28 is mounted on the end of each arm 29 by means of a cylindrical shaft 32. When a pair of clamping arms are in the lower position, as shown in FIG. 2, the discs 28 lip under the rail head 37 of the track and each disc 28 tightly grips the rail and pinches it in position against the roller 27. Each pair of clamping arms 29 are pivoted in unison by a respective hydraulic cylinder 41, which can be operated to move the clamping arms 29 between their lower clamping position, as shown in FIG. 2, and a raised position. The extendable shaft of each cylinder 41 is pivotally connected to extensions 43 of the respective arms 29 projecting above the beam 23 and the opposite end of both cylinders 41 is pivotally connected to a support 45 mounted on the top of the beam 23. When the cylinders 41 are operated to extend their shafts, they will cause the clamping arms 29 to pivot downward and clamp each rail against the rollers 27 at two positions spaced apart along the rail.

When the beam 23 is in its raised position, the lateral position of the beam 23 with respect to the rails can be adjusted by means of a hydraulic line-up cylinder or lateral stability cylinder 51 having one end pivotally connected to a support 52 fixed to and suspended below the bridge 15 and having its extendable shaft pivotally connected to a support 55 mounted on the top of the beam 23. By actuation of the hydraulic cylinder 51, the lateral position of the support member 23 can be adjusted. The cylinder 51 can also be selectively hydraulically held in position in a manner explained below. An end plate 61 is fixed to each end of the beam 23. A pair of stabilizing bars 53 are on each side of the vehicle are pivotally connected to the corresponding end plate 61 and pivotally connected at the other end to a support member 63 extending below the bridge 15 to prevent motion of the beam 23 in the direction parallel to the track rails.

In operation, the beam 23 will initially be in its raised position and the rail clamps 26 will be retracted to their raised position. To begin tie exchanging operations, the cylinder 51 is first operated to bring the rollers 27 into alignment with the inner edges of the track rails. The cylinders 25 are then operated to lower the beam 23 so that the rollers 27 move to adjacent the inner edges of the track rails as shown in FIG. 2. When the beam 23 has been lowered and the vehicle is not moving, the cylinder 51 will be hydraulically held in position. However, as soon as the motor of the vehicle is energized to begin motion of the vehicle in a forward or reverse direction, the cylinder 51 will be hydraulically connected to be floating so that as the vehicle moves, the lateral alignment of the beam 23 can be guided by the engagement of the rollers 27 with the track rails. When the vehicle comes to a position with the jaws 21 of the tie exchanging mechanism 19 over a cross tie to be removed, the hydraulic cylinder 51 will be automatically hydraulically held in position as soon as the vehicle stops. The hydraulic cylinders 41 are then actuated to pivot the rail clamps 26 to their lower position to grip each rail in two positions. The cross tie is then unfastened from the rails. Because the rails are gripped at two spaced points on each rail, the rails are prevented from flexing when the fastening hardware releases the tie from the rails. After the rails have been unfastened from the tie, the cylinders 25 are operated to lift the beam 23 slightly so that the discs 28 lipped under the rail heads lift the rails from the cross ties by an amount sufficient for the rail feet and fastening hardware to clear the cross ties. The tie exchanging mechanism 19 is then operated to lower the jaws 21 into a position to engage the end of the cross tie and the jaws on one side are actuated to grasp the end of the cross tie. Then the tie exchanging mechanism is operated to pull the cross tie from beneath the rail, and then push a new cross tie into position beneath the rail in the road bed. The cylinders 25 are then operated to lower the rails onto the new cross tie, which is then refastened to the rails. Then the rail clamps are pivoted to release the rails and the vehicle is advanced to the position of the next cross tie to be replaced where the operation is repeated.

Figure 3:
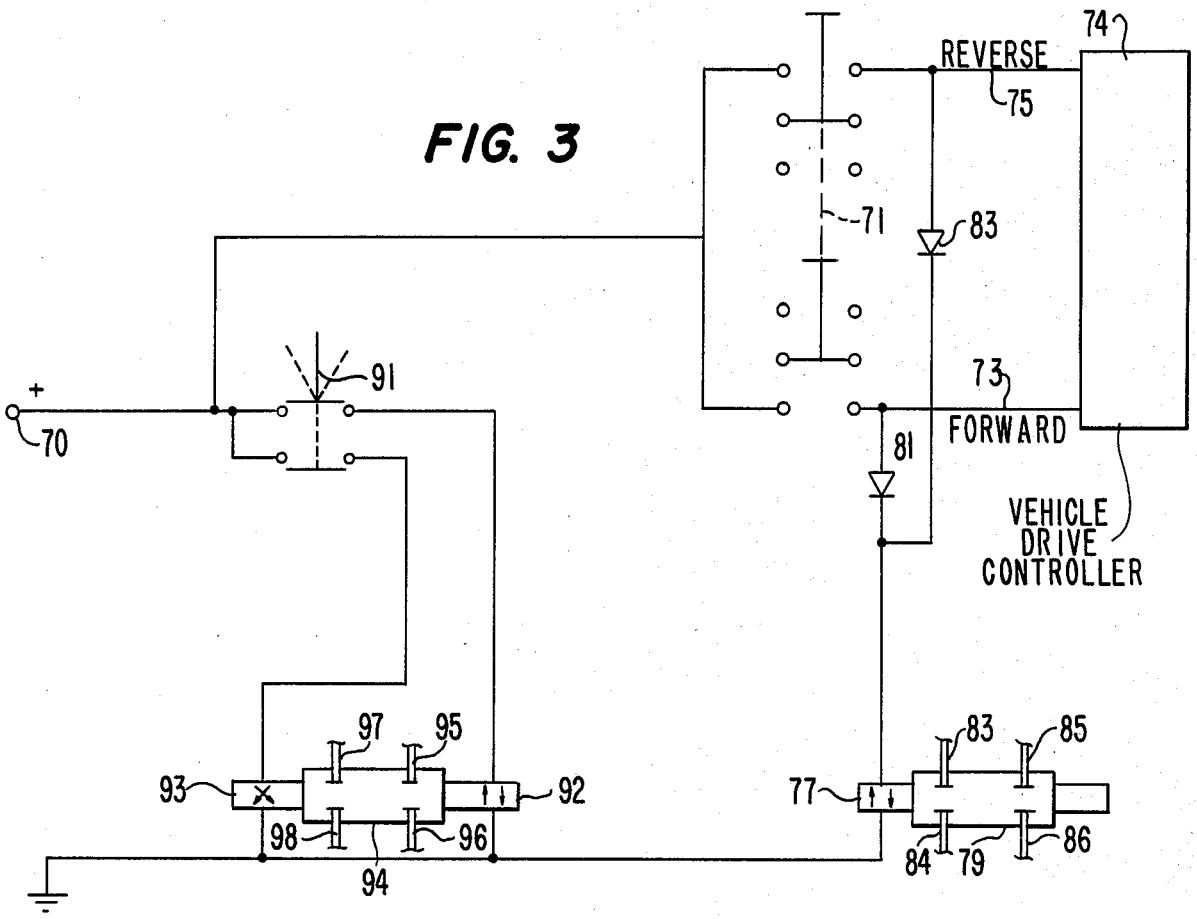
FIG. 3 is an electrical circuit diagram illustrating a circuit for controlling a portion of the track maintenance apparatus of the invention.

In the electrical control circuit for the tie exchanging mechanism, as shown in FIG. 3, the positive side of the DC source is applied to a terminal 70. A three-position double pole switch 71 in its lower position applies the positive voltage at terminal 70 over a conductor 73 to a vehicle direction controller 74 and in its upper position, applies the positive voltage over a conductor 75 to the vehicle direction controller. The vehicle direction controller 74 operates the track maintenance vehicle to move in the forward direction along the track when it receives the positive voltage on the conductor 73 and operates the track maintenance vehicle to move in the reverse direction when it receives the positive voltage on conductor 75. When the positive voltage is applied to either of the conductors 73 or 75, a solenoid 77 of a double hydraulic valve 79 will be energized by current flowing to ground through one of the diodes 81 or 83 from the positive power source. When the solenoid 77 is energized, the valve will complete the hydraulic connection between hydraulic lines 83 and 84 and between hydraulic lines 85 and 86. When the solenoid 77 is deenergized, the hydraulic connection in the valve 79 will disconnect the hydraulic lines 83–86 from each other and close them off.

A three-position single pole switch 91 is connected to energize a solenoid 92 or a solenoid 93 of a hydraulic switching valve 94 by connecting either the solenoid 92 or the solenoid 93 between the positive voltage source applied at terminal 70 and ground. When the solenoid 92 is energized, the valve 94 will complete a hydraulic connection between hydraulic lines 95 and 96 and between hydraulic lines 97 and 98. When the solenoid 93 is energized, the valve 94 will complete hydraulic connections between lines 97 and 96 and between lines 95 and 98. When the switch 91 is in its middle position, neither solenoid 92 or 93 is energized, and the valve 94 will disconnect the hydraulic lines 95-98 from each other and close them off.

Figure 4:
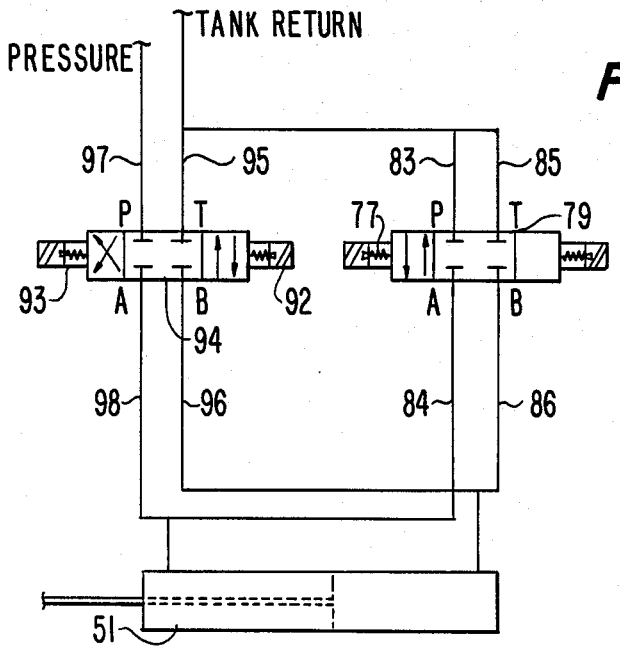
FIG. 4 is a hydraulic circuit diagram illustrating a hydraulic circuit for controlling a portion of the track maintenance apparatus of the invention.

The hydraulic circuit controlled by the hydraulic valves 79 and 94 is shown in FIG. 4. As shown in FIG. 4, the hydraulic lines 83 and 85 are connected to the hydraulic tank return line of a hydraulic pump. The hydraulic line 95 is also connected to the hydraulic tank return. The output pressure line from the hydraulic pump is connected to hydraulic line 97. The hydraulic lines 84 and 86 are connected to the opposite sides of the hydraulic line-up cylinder 51 and the hydraulic lines 96 and 98 are also connected to opposite sides of the hydraulic line-up cylinder 81.

To control the hydraulic line-up cylinder 51 and move it in one direction or the other, the switch 91 is operated to energize the solenoid valve 92 or the solenoid valve 93. When the solenoid valve 92 is energized, as explained above, the hydraulic line 95 will be connected to hydraulic line 96 and the hydraulic line 97 will be connected to hydraulic line 98. As a result, the line-up cylinder 51 will be pressurized to move the beam 23 to the right as shown in FIG. 2. When the switch 91 is operated to energize the solenoid 93, the hydraulic line 97 will be connected to the hydraulic line 96 and the hydraulic line 95 will be connected to the hydraulic line 98. As a result, the hydraulic line-up cylinder will be pressurized to move the beam 23 to the left as seen in FIG. 2.

When the vehicle is moved in a forward or reverse direction, the switch 91 will be positioned in its middle position to energize neither solenoid 92 or 93 so that the hydraulic lines to the valve 94 will be disconnected in the valve 94. The solenoid 77 will be automatically energized so that the hydraulic line 83 is connected to the hydraulic line 84 and the hydraulic line 85 will be connected to the hydraulic line 86. As a result, both sides of the line-up cylinder 51 will be connected to the hydraulic tank return. As a result, the cylinder 51 will float and can be moved to the right or the left as the vehicle moves along the track by the rail heads 37 pushing on the rollers 27 so as to maintain the rail clamps lined up with the rails as the vehicle moves. When the vehicle is brought to a stop, by moving the switch 71 to its middle position, the solenoid 77 will be de-energized. As a result, the hydraulic lines 84 and 86 will be closed off in the valve 79 and the cylinder 51 will be hydraulically held in position.

In the operation of the system of the invention, the cylinders 25 will initially position the beam 23 in its upper position, and the cylinders 41 will initially position the rail clamps 26 in their retracted position. As a first step, the switch 91 is operated to position the beam 23 in alignment with the rails. Then, the cylinders 25 are operated to lower the beam 23 while leaving the rail clamps 26 retracted. The switch 71 is then operated to control the vehicle movement to move in a forward or reverse direction to the cross tie to be removed. When the vehicle is moving, the valve 77 will be energized so that the line-up cylinder 51 is floating to permit the beam 23 to be guided in position by the rollers 27 engaging the inner edges of the rail heads 37. When the maintenance vehicle reaches a position over a tie to be removed, the switch 71 is moved to its middle position whereupon the valve 77 will be de-energized and the line-up cylinder 51 will be hydraulically held in position. The hydraulic cylinders 41 are then operated to cause the rail clamps 26 to grip the track rails and the tie replacement proceeds in the manner described above.

The above described track maintenance vehicle, by clamping the rails in two positions before they are released from the cross ties, prevents the ties from flexing even when the rails have been elongated in hot weather conditions and, thus, the problem of rail flexing during cross tie removal is overcome.

The above description is of a preferred embodiment of the invention and many variations may be made thereto without departing from the spirit and scope of the invention which is defined in the appended claims.

I claim:

1. In a railway track maintenance apparatus comprising a railway vehicle having a pair of front railway wheels and a pair of rear railway wheels and adapted for movement along the rails of a railway, and tie replacement means mounted on said vehicle between said pairs of railway wheels for removing and replacing cross ties in the roadbed from beneath the rails of said railway, the improvement comprising rail locking means mounted on said vehicle between said pairs of railway wheels adjacent to said tie replacement means, for locking said rails while removing and replacing cross ties and including rail clamping means operable to engage the opposite sides of each rail of said railway between said pairs of rail wheels adjacent to said means for removing and replacing cross ties; and means on said vehicle for holding each rail in a fixed position laterally relative to said vehicle and to each other with sufficient force to prevent movement of such rail in either lateral direction when said rail would otherwise flex laterally out of alignment upon being released from a tie in said roadbed adjacent to said clamping means; and means for lifting said rails relative to said vehicle sufficiently to clear said cross ties to be replaced while said holding means continue to hold said rails in a substantially fixed lateral position relative to said vehicle, said holding means being continuously laterally adjustable independent of the position of said vehicle relative to said rails as determined by said pairs of wheels relative to said rails while said railway vehicle moves along said rails, said holding means thus laterally fixing the relative position of said rails while lifted from said cross tie so that said rails will be refunded to said cross tie at their original position.

2. A track maintenance apparatus as recited in claim 1, wherein said lifting means selectively raises and lowers support means mounted on said vehicle supporting said rail clamping means, whereby said rail may be raised clear of the cross tie to be removed by means of said rail clamping means when said rail clamping means are pivoted to their rail engaging position, while stabilized against lateral displacement by said lateral stabilizing means.

3. A track maintenance apparatus as recited in claim 1, wherein said lifting means selectively raises and lowers, support means mounted on said vehicle supporting said rail clamping means, whereby said rail may be raised clear of the cross tie to be removed by means of said rail clamping means when said rail clamping means grips said rail, while stabilized against lateral displacement by said lateral stabilizing means.

4. A railway track maintenance apparatus as claimed in claim 1, wherein said rail clamping means is supported on a beam mounted on said vehicle and said holding means is operable to hold said beam in a fixed lateral position relative to said railway vehicle.

5. A railway track maintenance apparatus as claimed in claim 4, wherien said holding means to fix the lateral position of said beam is operable to permit said beam to move laterally with respect to said vehicle and wherein said rail clamping means includes means to support said beam to maintain said rail clamping means aligned with said rails as said vehicle moves along said railway.

6. A method of replacing a cross tie in the roadbed of a railway comprising the steps of: (a) longitudinally positioning a railway vehicle having a pair of front railway wheels and a pair of rear railway wheels to straddle the cross tie to be replaced, (b) continuoously laterally adjusting, while said vehicle is moving along rails in said railway during said positioning step, the position of rail gripping members supported by a laterally adjustable support member relative to said rails intermediate said front and said real railway wheels in response to a guide member engaging a rail; (c) fixing the position of said vehicle and engaging the opposite sides of each of the rails of the railway with said rail gripping members supported on said support member between said pairs of railway wheels, thus to grip the rails adjacent to the cross tie to be replaced between said front pair of wheels and said rear pair of wheels, (d) lifting the rails while secured to said rail gripping member while continuing to stabilize said rails laterally relative to each other, (e) then pulling the cross tie to be replaced laterally from beneath the rails of said railway without releasing said holding step by means for removing said ties, said means also being located between said front and rear wheels of said railway vehicle, (f) pushing a new cross tie into the position from which the cross tie to be replaced was removed, and (g) lowering said rails to thus original position and releasing the grip upon the rails.

7. In a railway track maintenance apparatus comprising a railway vehicle having a pair of front railway wheels and a pair of rear railway wheels and adapted for movement along the rails of a railway and means mounted on said vehicle between said pairs of railway wheels for removing and replacing ties from beneath the rails of said railway, the improvement comprising the combination of:

means supported by a beam member extending laterally relative to said rails for clamping the rails beneath said vehicle between said front railway wheels and sair rear railways wheels;

means supported by said vehicle for lifting said beam member to lift said clamped rails relative to said vehicle to a positiong clear of a tie for removal and insertion of ties beneath said rails; and lateral stabilizing means supported by said vehicle including said beam member for laterally stabilizing said rails, when lifted, against lateral displacement, and for continuously laterally positioning said beam member relative to said rails in response to a guide member engaging said rails when said clamping means is free from engagement with said rail and said lateral positioning being independent of lateral movement of said vehicle determined by said pairs of wheels engaging said rails.

8. The combination as set forth in claim 7, wherein said lateral stabilizing means includes a lateral stability cylinder secured to said beam member which is hydraulically locked when said rails are lifted to prevent lateral displacement of said rails.

9. The combination as set forth in claim 7, wherein said clamping means includes said beam member supporting rail clamps for gripping said rails and extending laterally relative to rails beneath said vehicle and means for raising or lowering said beam member on command, said lateral stability means connecting said beam member and said vehicle and coacting therewith to adjust the lateral position of said beam member relative to the paired rails of said railway.

10. The combination as set forth in claim 9, wherein said lateral stabilizing means is a lateral stability cylinder.

11. The combination as set forth in claim 10, wherein said lateral stability cylinder is hydraulically locked to maintain the lateral position of said clamping means and said beam member during lifting of said clamped rails.

12. The apparatus as set forth in claim 11, wherein said vehicle includes a bridge member, said lifting means comprises hydraulic cylinders secured to said bridge member and to said beam member, said clamping means being secured to said beam member.

13. The apparatus as set forth in claim 12, wherein said lateral stabilizing cylinder is secured to an adjustable support suspended from said bridge member, and further including an end plate fixed at each end of said beam member, and a pair of stabilizing bars respectively connected at one end of said end plates and pivotally connected at the other to a second support member.

14. A railway track maintenance apparatus comprising:

a railway vehicle having a pair of front railway wheels and a pair of rear railway wheels and adapted for longitudinal movement along the rails of a railway, said wheels engaging said rails for proving all of the support for said vehicle while lifting rails from beneath said vehicle between said pairs of railway wheels, thus to avoid disturbing ballast for said rails, and tie replacing means mounted on said vehicle between said pairs of railway wheels for removing and replacing ties from beneath the rails of said railway;

rail clamping means including a rail clamp and a guide portion, for clamping said rails beneath said vehicle and for lifting said rails free from engagement with ties for said rails to permit ties beneath said rails to be exchanged; and clamp positioning means located intermediate said pairs of railway wheels beneath said vehicle, said clamp positioning means being transversely movable relative to said vehicle and to a rail for continuously transversely positioning said clamping means and said clamp along said rail while said vehicle is longitudinally indexing along said rail, such transverse movement being in response to said guide portion of said clamping means engaging said rails and independent of the positioning of said vehicle determined by said pairs of wheels, said clamp positioning means being fixed relative to said rail when said vehicle is stationary to exchange a tie, so that said clamping means engages said rail at an original rail position, lifts said rail to exchange a tie beneath said rail, and returns said rail to its original position.

15. In a railway track maintenance apparatus comprsing a railway vehicle having a pair of fron railway wheels and a pair of rear railway wheels and adapted for movement along the rails of a railway, and tie replacement means mounted on said vehicle between said pairs of railway wheels for removing and replacing cross ties in the roadbed from beneath the rails of said railway, the improvement comprising tail locking means, mounted on said vehicle between said pairs of railway wheels adjacent to said tie replacement means, for locking said rails while removing and replacing cross ties and including rail clamping means operable to engage the opposite sides of each rail of said railway between said pairs of rail wheels adjacent to said means for removing and replacing cross ties and means for holding each rail in a fixed position laterally relative to said vehicle and to each other with sufficient force to prevent movement of such rail in either lateral direction when such tail would otherwise flex laterally out of alignment upon being released from a tie in said roadbed adjacent to said clamping means; and means for lifting said rails relative to said vehicle sufficiently to clear said cross ties to be replaced while said holding means continues to hold said rails in a substantially fixed lateral position relative to said vehicle, said holding means being laterally adjustable relative to said rail, said holding means thus laterally stabilizing the relative position of said rails while lifted from said cross tie, wherein said rail locking means including support means is mounted on said vehicle, said rail clamping means is mounted on said support means, and said holding means is operable to hold said support means in a fixed lateral position relative to said vehicle, or permits said support means to move laterally with respect to said vehicle, said holding means including lateral stabilizing means to guide the lateral movement of said support means relative to said vehicle to maintain said rail clamping means freely aligned with said rails as said vehicle moves along said railway.

16. A track maintenance apparatus as recited in claim 15, wherein said lateral stabilizing means to guide said support means comprises rollers mounted on said support means adapted to engage said track and a lateral stabilizing cylinder for laterally guiding said support means to position said support means relative to said rails.

17. A track maintenance apparatus as recited in claim 16, wherein said rollers are adapted to be positioned to engage the inner side edges of the rail heads of said rails.

18. A track maintenance apparatus as recited in claim 17, wherein said rail clamping means comprises means to pinch said rails against said rollers.

19. A track maintenance apparatus as recited in claim 18, wherein said means to pinch said rails comprises arms pivotally mounted on said support means to move between a retracted position and a rail engaging position, said arms having rail engaging members shaped to lip under the rail heads of said rails when said arms are pivoted to their rail engaging positions.

20. A track maintenance apparatus as recited in claim 19, wherein said lifting means selectively raises and lowers said support means whereby said rail may be raised clear of the cross tie to be removed by means of said rail clamping means when said arms are pivoted to their rail engaging position, while stabilized against lateral displacement by said lateral stabilizing means.

21. A track maintenance apparatus as recited in claim 19, wherein said lifting means selectively raises and lowers said support means whereby said rail may be raised clear of the cross tie to be removed by means of said rail clamping means when said rail clamping means grips said rail, while stabilzed against lateral displacement by said lateral displacement means.

22. A railway track maintenance apparatus as claimed in claim 15, wherein said rail clamping means is supported on a beam mounted on said vehicle, and includes means operable to engage opposite sides of one of said rails between said pairs of railway wheels operating to hold said rail in a fixed position relative to said beam, and holding means is operable to hold said beam in a substantially fixed lateral position relative to said railway vehicle.

23. A railway track maintenance apparatus as claimed in claim 22, wherein said holding means to fix the lateral position of said beam is operable to permit said beam to move laterally with respect to said vehicle and wherein said rail engaging means includes engaging means to guide said beam to maintain said rail clamping means aligned with said rails as said vehicle moves along said railway.

24. A track maintenance apparatus as recited in claim 23, wherein said means to guide said beam comprises rollers mounted on said beam adapted to engage the sides of said rails.

25. A track maintenance apparatus as recited in claim 24, wherein said rail engaging means comprises means to pinch said rails against said rollers.

26. A track maintenance apparatus as recited in claim 25, wherein said means to engage said rails abuts against opposite vertical side surfaces of said rail.

* * * * *

UNITED STATES PATENT AND TRADEMARK OFFICE

CERTIFICATE OF CORRECTION

PATENT NO. : 4,770,103

DATED : September 13, 1988

INVENTOR(S) : Franz Allmer

It is certified that error appears in the above-identified patent and that said Letters Patent is hereby corrected as shown below:

Column 1, line 14, "assigneee" should read -- assignee --;

Column 6, line 19, "refunded" to read -- returned -- (claim 1);

Column 6, line 44, "wherien" should read -- wherein -- (claim 5);

Column 6, line 54, "continuoously" should read -- continuously -- (claim 6);

Column 6, line 59, "real" should read -- rail -- (claim 6);

Column 7, line 13, "raIls" should read -- rails -- (claim 7);

UNITED STATES PATENT AND TRADEMARK OFFICE

CERTIFICATE OF CORRECTION

PATENT NO. : 4,770,103

DATED : September 13, 1988

INVENTOR(S) : Franz Allmer

It is certified that error appears in the above-identified patent and that said Letters Patent is hereby corrected as shown below:

Column 7, line 21, "sair" should read -- said -- (claim 7);

Column 8, line 37, "fron" should read -- front -- (claim 15);

Column 8, line 43, "tail" should read -- rail -- (claim 15); and

Column 10, line 6, "stablized" should read -- stabilized -.

Signed and Sealed this

Twenty-fourth Day of January, 1989

*Attest:*

*Attesting Officer*

DONALD J. QUIGG

*Commissioner of Patents and Trademarks*